US010964461B1

(12) United States Patent
Shin et al.

(10) Patent No.: US 10,964,461 B1
(45) Date of Patent: Mar. 30, 2021

(54) RESISTOR ELEMENT

(71) Applicant: SAMSUNG ELECTRO-MECHANICS CO., LTD., Suwon-si (KR)

(72) Inventors: Yeon Hee Shin, Suwon-si (KR); Ji Sook Yoon, Suwon-si (KR); Kwang Hyun Park, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 0 days.

(21) Appl. No.: 16/902,764

(22) Filed: Jun. 16, 2020

(30) Foreign Application Priority Data

Dec. 10, 2019 (KR) ..... 10-2019-0163689

(51) Int. Cl.

| | |
|---|---|
| ***H01C 17/00*** | (2006.01) |
| ***H01C 1/012*** | (2006.01) |
| ***H01C 17/12*** | (2006.01) |
| ***H01C 1/142*** | (2006.01) |

(52) U.S. Cl.
CPC ..... *H01C 17/006* (2013.01); *H01C 1/012* (2013.01); *H01C 1/142* (2013.01); *H01C 17/12* (2013.01)

(58) Field of Classification Search
CPC ..... H01C 17/006; H01C 17/12; H01C 1/142
See application file for complete search history.

(56) References Cited

U.S. PATENT DOCUMENTS

| | | | | |
|---|---|---|---|---|
| 7,098,768 | B2 * | 8/2006 | Doi | H01C 1/14 338/309 |
| 9,508,473 | B2 * | 11/2016 | Yoneda | H01C 17/02 |
| 9,704,621 | B2 * | 7/2017 | Ogawa | H01C 17/006 |
| 2011/0057765 | A1 * | 3/2011 | Ryu | H01C 17/02 338/252 |

(Continued)

FOREIGN PATENT DOCUMENTS

| | | | |
|---|---|---|---|
| JP | 2005-108865 | A | 4/2005 |
| JP | 2015-008189 | A | 1/2015 |

(Continued)

OTHER PUBLICATIONS

Korean Office Action dated Nov. 16, 2020 issued in Korean Patent Application No. 10-2019-0163689 (with English translation).

*Primary Examiner* — Kyung S Lee
(74) *Attorney, Agent, or Firm* — Morgan, Lewis & Bockius LLP

(57) ABSTRACT

A resistor element includes a base substrate having a first surface and a second surface, a resistive layer having a first surface disposed on the second surface of the base substrate, a second surface opposing the first surface of the resistive layer, and first to fourth sides connecting the first surface of the resistive layer to the second surface of the resistive layer, and internal electrodes spaced apart from each other on the second surface of the base substrate. The first and second sides of the resistive layer face each other in a direction in which the internal electrodes are spaced apart, and the third and fourth sides of the resistive layer connect the first and second sides. With the second surface of the base substrate, an angle between each of the third and fourth sides is greater than an angle between each of the first and second sides.

20 Claims, 15 Drawing Sheets

(56) References Cited

U.S. PATENT DOCUMENTS

| | | | | |
|---|---|---|---|---|
| 2011/0057767 | A1* | 3/2011 | Ryu | H01C 1/14 338/309 |
| 2015/0357097 | A1* | 12/2015 | Tsai | H01C 1/142 338/309 |
| 2016/0125981 | A1 | 5/2016 | Kim et al. | |
| 2016/0247610 | A1* | 8/2016 | Shinoura | H01C 17/02 |
| 2017/0202089 | A1 | 7/2017 | Yun et al. | |
| 2018/0090247 | A1* | 3/2018 | Matsumoto | H01C 7/003 |
| 2020/0090838 | A1* | 3/2020 | Nakao | H01C 1/02 |

FOREIGN PATENT DOCUMENTS

| | | | |
|---|---|---|---|
| KR | 10-2016-0052283 | A | 5/2016 |
| KR | 10-2017-0083352 | A | 7/2017 |

* cited by examiner

RESISTOR ELEMENT

CROSS-REFERENCE TO RELATED APPLICATION(S)

The present application claims the benefit of priority to Korean Patent Application No. 10-2019-0163689, filed on Dec. 10, 2019 in the Korean Intellectual Property Office, the entire disclosure of which is incorporated herein by reference.

TECHNICAL FIELD

The present disclosure relates to a resistor element.

BACKGROUND

The chip-shaped resistive element is suitable for realizing a precision resistor, and may serve to regulate a current in a circuit and drop a voltage.

With the trend for the miniaturization of electronic devices, there is increasing demand for resistance elements capable of more effectively controlling current flowing through a circuit within the same area.

On the other hand, when forming a resistive layer embedded in a related art resistive element by using a printing method, there is a problem in that alignment accuracy decreases and print smearing occurs. Accordingly, there is a need to implement a resistance element that may more accurately control the flow of current within the same area.

SUMMARY

This Summary is provided to introduce a selection of concepts in simplified form that are further described below in the Detailed Description. This Summary is not intended to identify key features or essential features of the claimed subject matter, nor is it intended to be used as an aid in determining the scope of the claimed subject matter.

An aspect of the present disclosure is to provide a resistor element in which the path of current may be more precisely controlled within the same area.

According to an aspect of the present disclosure, a resistor element may include a base substrate having a first surface and a second surface opposing the first surface, a third surface and a fourth surface connecting the first surface and the second surface and opposing each other, and a fifth surface and a sixth surface connecting the first surface and the second surface and opposing each other, a resistive layer having a first surface disposed on the second surface of the base substrate and facing the first surface of the base substrate, a second surface opposing the first surface of the resistive layer, and first to fourth sides connecting the first surface of the resistive layer to the second surface of the resistive layer, and first and second internal electrodes spaced apart from each other on the second surface of the base substrate and connected to the resistive layer. The first and second sides of the resistive layer may face each other in a direction in which the first and second internal electrodes are spaced apart, and the third and fourth sides of the resistive layer may connect the first and second sides to each other and face each other. An angle between each of the third and fourth sides of the resistive layer with the second surface of the base substrate may be greater than an angle between each of the first and second sides of the resistive layer with the second surface of the base substrate.

According to another aspect of the present disclosure, a resistor element may include a base substrate having a first surface and a second surface opposing each other in a thickness direction, a third surface and a fourth surface connecting the first surface to the second surface and opposing each other in a longitudinal direction, and a fifth surface and a sixth surface connecting the first surface to the second surface and opposing each other in a width direction; a resistive layer having a first surface disposed on the second surface of the base substrate and facing the first surface of the base substrate, a second surface opposing the first surface of the resistive layer, and first to fourth sides connecting the first surface of the resistive layer to the second surface of the resistive layer, the first and second sides opposing each other in the longitudinal direction, the third and fourth sides opposing each other in the width direction; and first and second internal electrodes spaced apart from each other on the second surface of the base substrate and connected to the resistive layer. An angle between each of the third and fourth sides of the resistive layer and the second surface of the base substrate may be 20 degrees or more and 90 degrees or less.

BRIEF DESCRIPTION OF THE DRAWINGS

The above and other aspects, features, and advantages of the present disclosure will be more clearly understood from the following detailed description, taken in conjunction with the accompanying drawings, in which.

DETAILED DESCRIPTION

Figure 1:
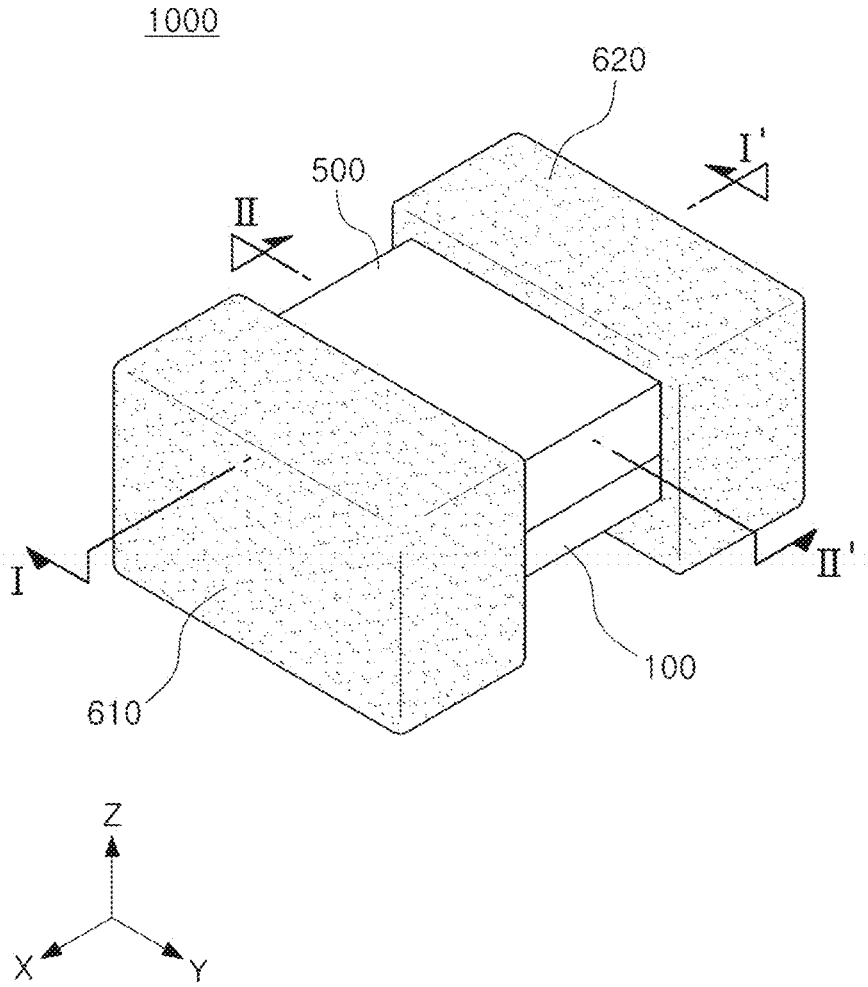
FIG. 1 is a perspective view schematically illustrating a resistor element according to an exemplary embodiment.

The following detailed description is provided to assist the reader in gaining a comprehensive understanding of the methods, apparatuses, and/or systems described herein. However, various changes, modifications, and equivalents of the methods, apparatuses, and/or systems described herein will be apparent to one of ordinary skill in the art. The sequences of operations described herein are merely examples, and are not limited to those set forth herein, but may be changed as will be apparent to one of ordinary skill in the art, with the exception of operations necessarily occurring in a certain order. Also, descriptions of functions and constructions that would be well known to one of ordinary skill in the art may be omitted for increased clarity and conciseness.

The features described herein may be embodied in different forms, and are not to be construed as being limited to the examples described herein. Rather, the examples described herein have been provided so that this disclosure will be thorough and complete, and will fully convey the scope of the disclosure to one of ordinary skill in the art.

Herein, it is noted that use of the term "may" with respect to an example or embodiment, e.g., as to what an example or embodiment may include or implement, means that at least one example or embodiment exists in which such a feature is included or implemented while all examples and embodiments are not limited thereto.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there may be no other elements intervening therebetween.

As used herein, the term "and/or" includes any one and any combination of any two or more of the associated listed items.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms such as "above," "upper," "below," and "lower" may be used herein for ease of description to describe one element's relationship to another element as illustrated in the figures. Such spatially relative terms are intended to encompass different orientations of the device in use or operation in addition to the orientation depicted in the figures. For example, if the device in the figures is turned over, an element described as being "above" or "upper" relative to another element will then be "below" or "lower" relative to the other element. Thus, the term "above" encompasses both the above and below orientations depending on the spatial orientation of the device. The device may also be oriented in other ways (for example, rotated 90 degrees or at other orientations), and the spatially relative terms used herein are to be interpreted accordingly.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

Due to manufacturing techniques and/or tolerances, variations of the shapes illustrated in the drawings may occur. Thus, the examples described herein are not limited to the specific shapes illustrated in the drawings, but include changes in shape that occur during manufacturing.

The features of the examples described herein may be combined in various ways as will be apparent after an understanding of the disclosure of this application. Further, although the examples described herein have a variety of configurations, other configurations are possible as will be apparent after an understanding of the disclosure of this application.

The drawings may not be to scale, and the relative size, proportions, and depiction of elements in the drawings may be exaggerated for clarity, illustration, and convenience.

In the drawings, the X direction may be defined as a first direction or a longitudinal direction, a Y direction as a second direction or a width direction, and a Z direction as a third direction or a thickness direction.

A value used to describe a parameter such as a 1-D dimension of an element including, but not limited to, "length," "width," "thickness," diameter," "distance," "gap," and/or "size," a 2-D dimension of an element including, but not limited to, "area" and/or "size," a 3-D dimension of an element including, but not limited to, "volume" and/or "size", and a property of an element including, not limited to, "roughness," "density," "weight," "weight ratio," and/or "molar ratio" may be obtained by the method(s) and/or the tool(s) described in the present disclosure. The present disclosure, however, is not limited thereto. Other methods and/or tools appreciated by one of ordinary skill in the art, even if not described in the present disclosure, may also be used.

Hereinafter, a resistor element according to an exemplary embodiment will be described in detail with reference to the accompanying drawings, and in describing with reference to the accompanying drawings, the same or corresponding components are assigned the same reference numbers, and overlapped descriptions thereof will be omitted.

Resistor Element

Figure 2:
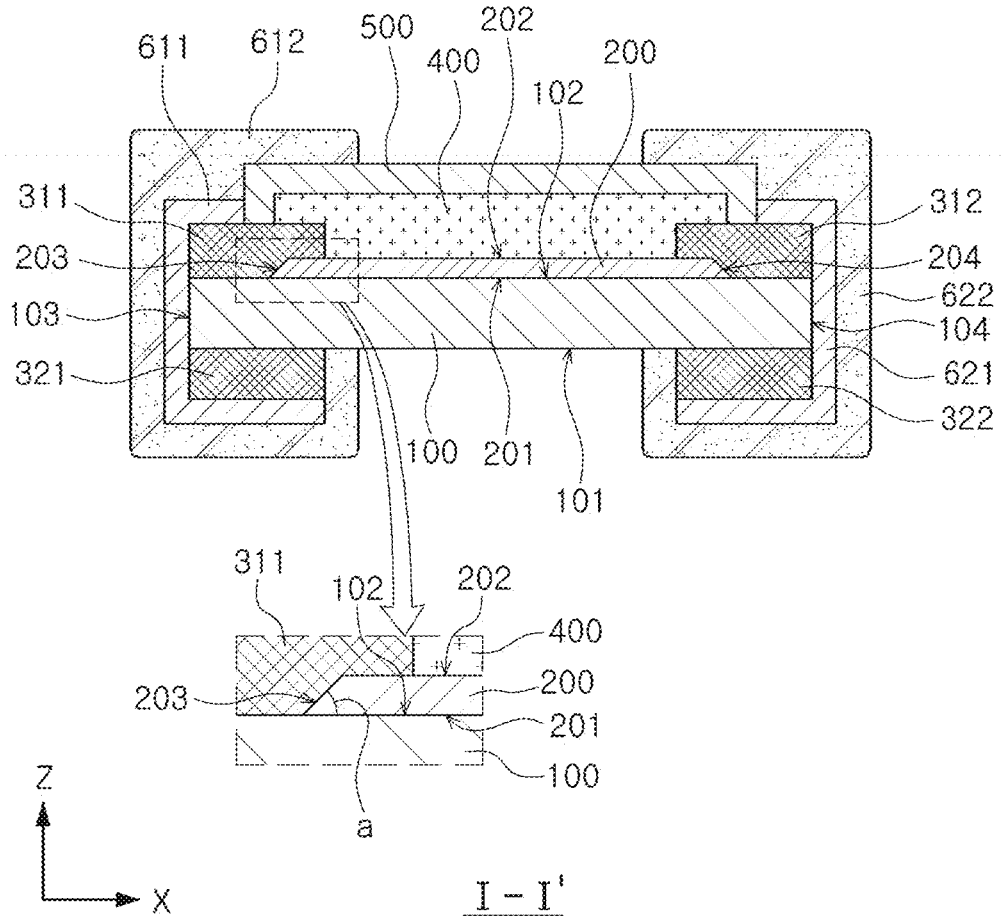
FIG. 2 is a cross-sectional view taken along line I-I' in FIG. 1.
Figure 3:
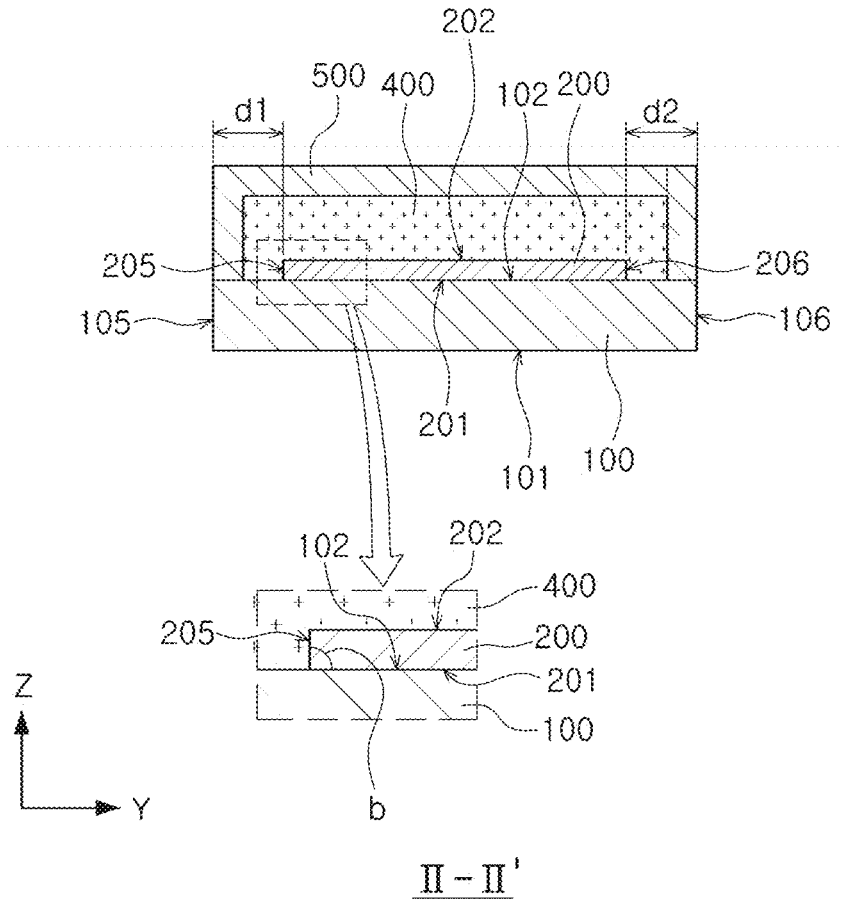
FIG. 3 is a cross-sectional view taken along line II-II' of FIG. 1.

FIG. 1 is a perspective view schematically illustrating a resistor element according to an exemplary embodiment. FIG. 2 is a cross-sectional view taken along line I-I' of FIG. 1. FIG. 3 is a cross-sectional view taken along line II-II' of FIG. 1.

Figure 5A:
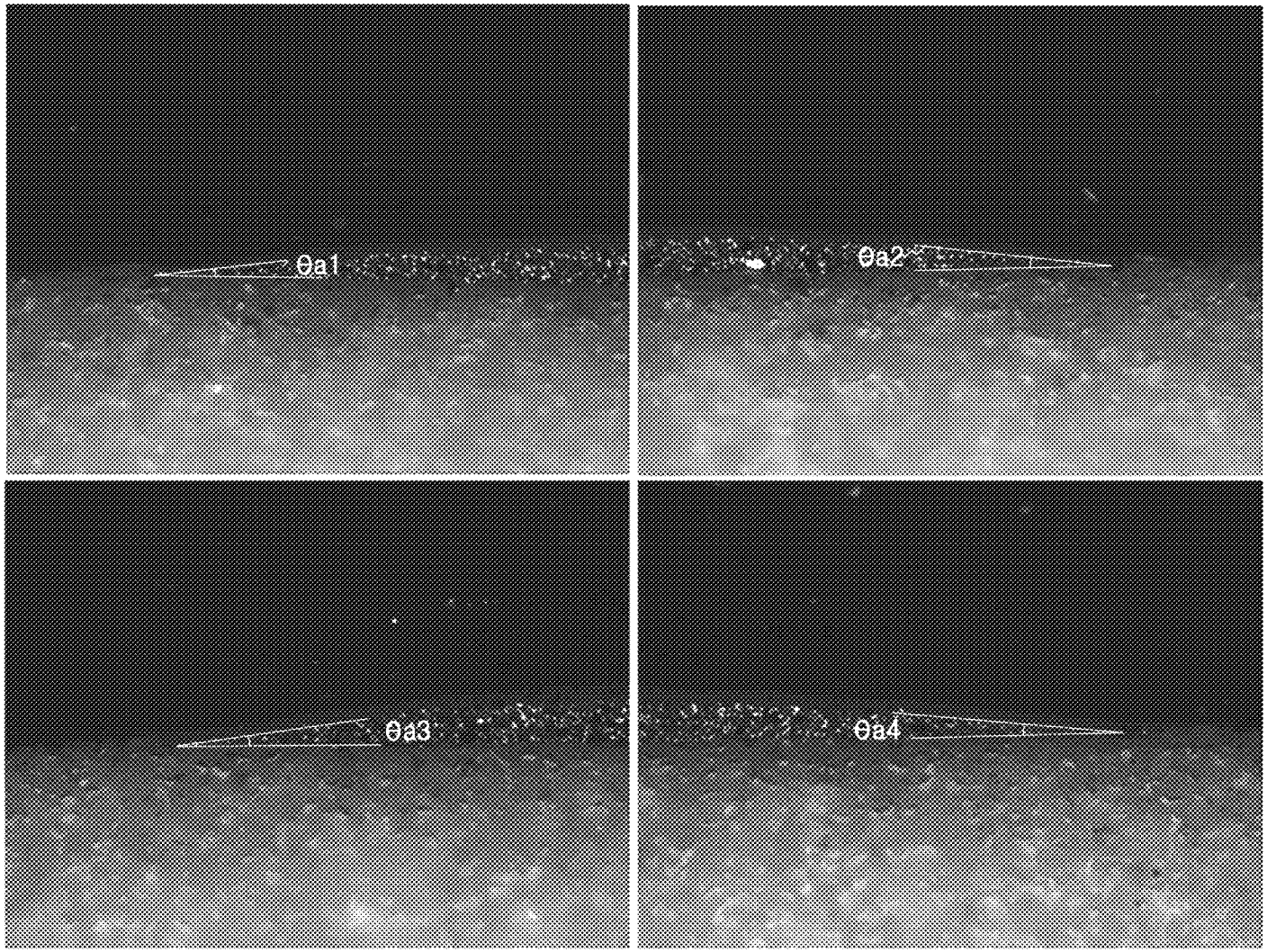
FIGS. 5A to 5C are views illustrating a resistive layer corresponding to FIG. 2.
Figure 5B:
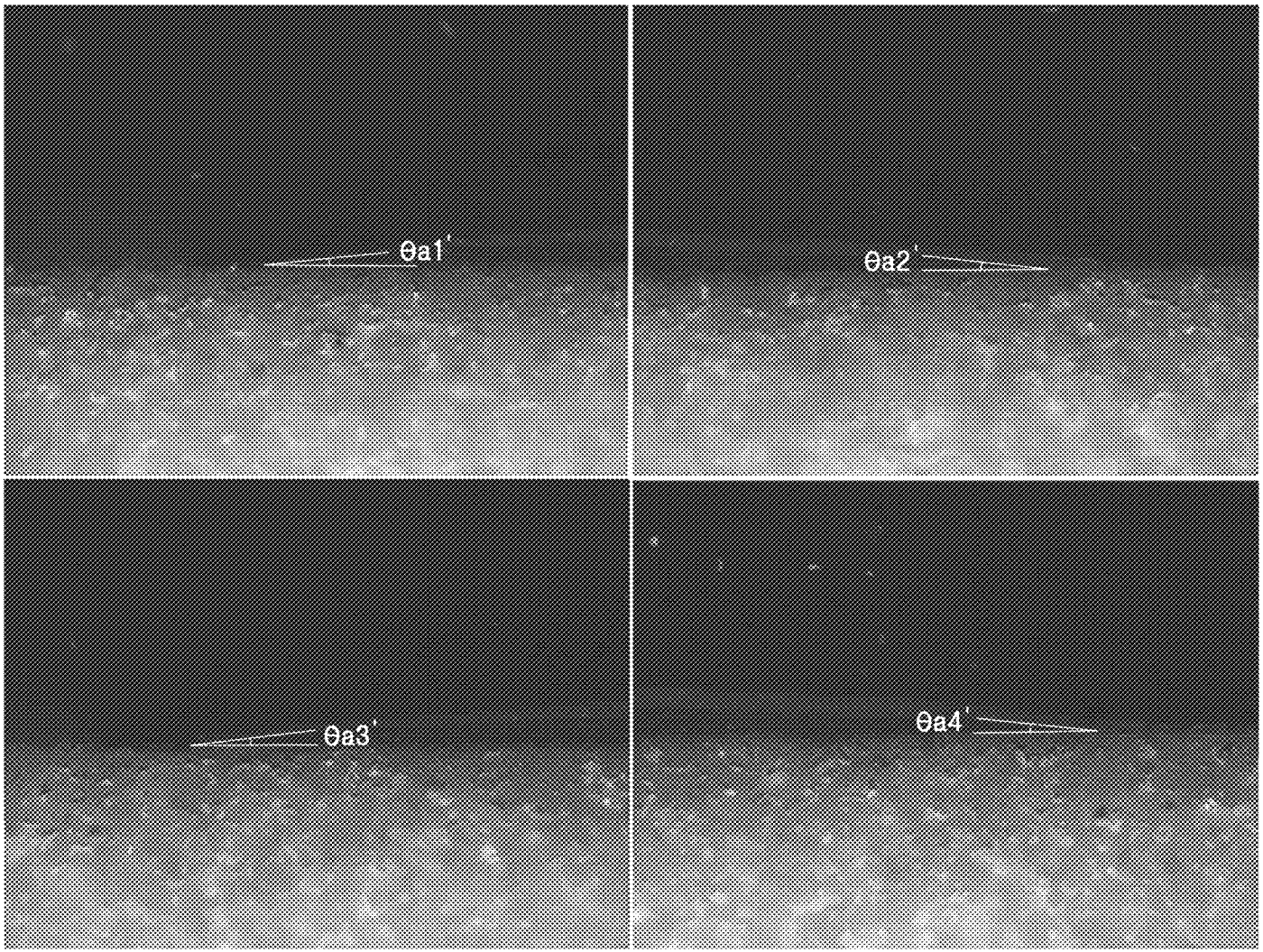
Figure 5C:
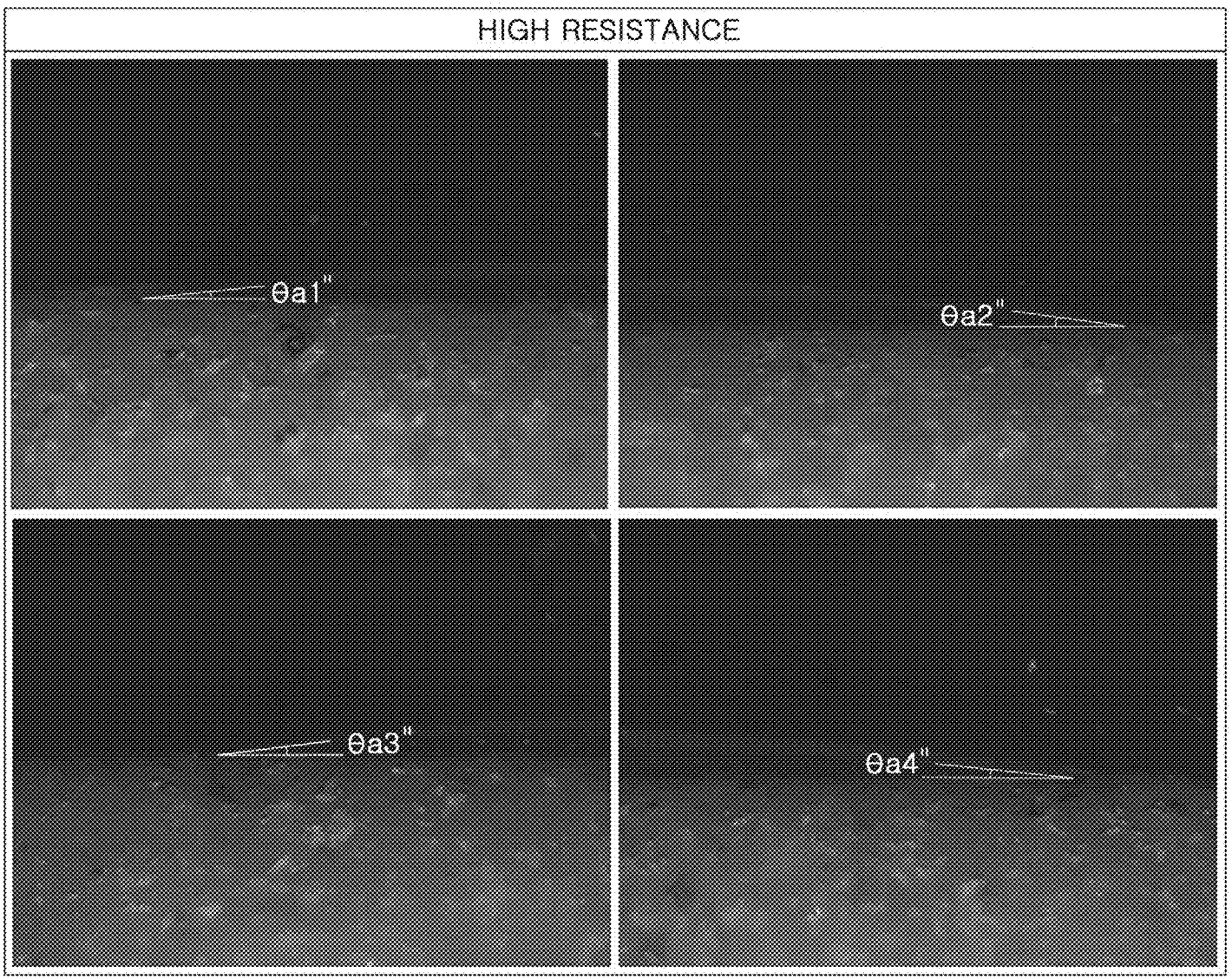
Figure 6A:
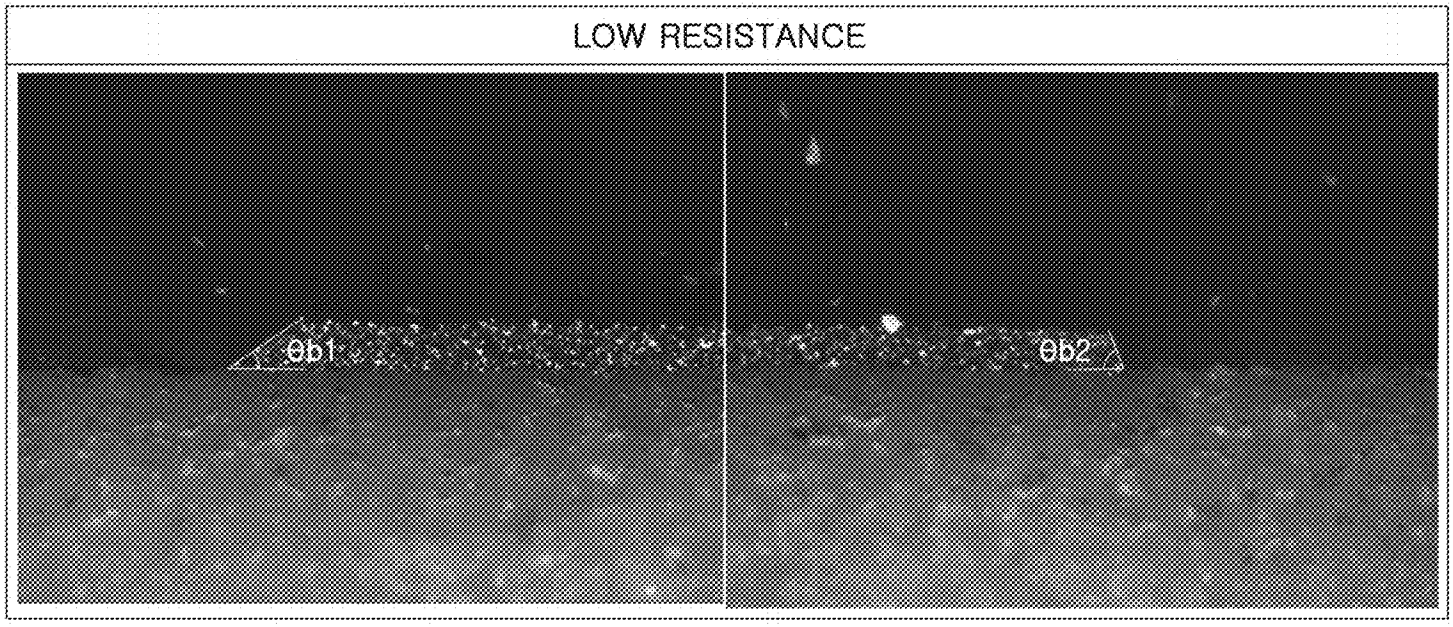
FIGS. 6A to 6C are views illustrating a resistive layer corresponding to FIG. 3.
Figure 6B:
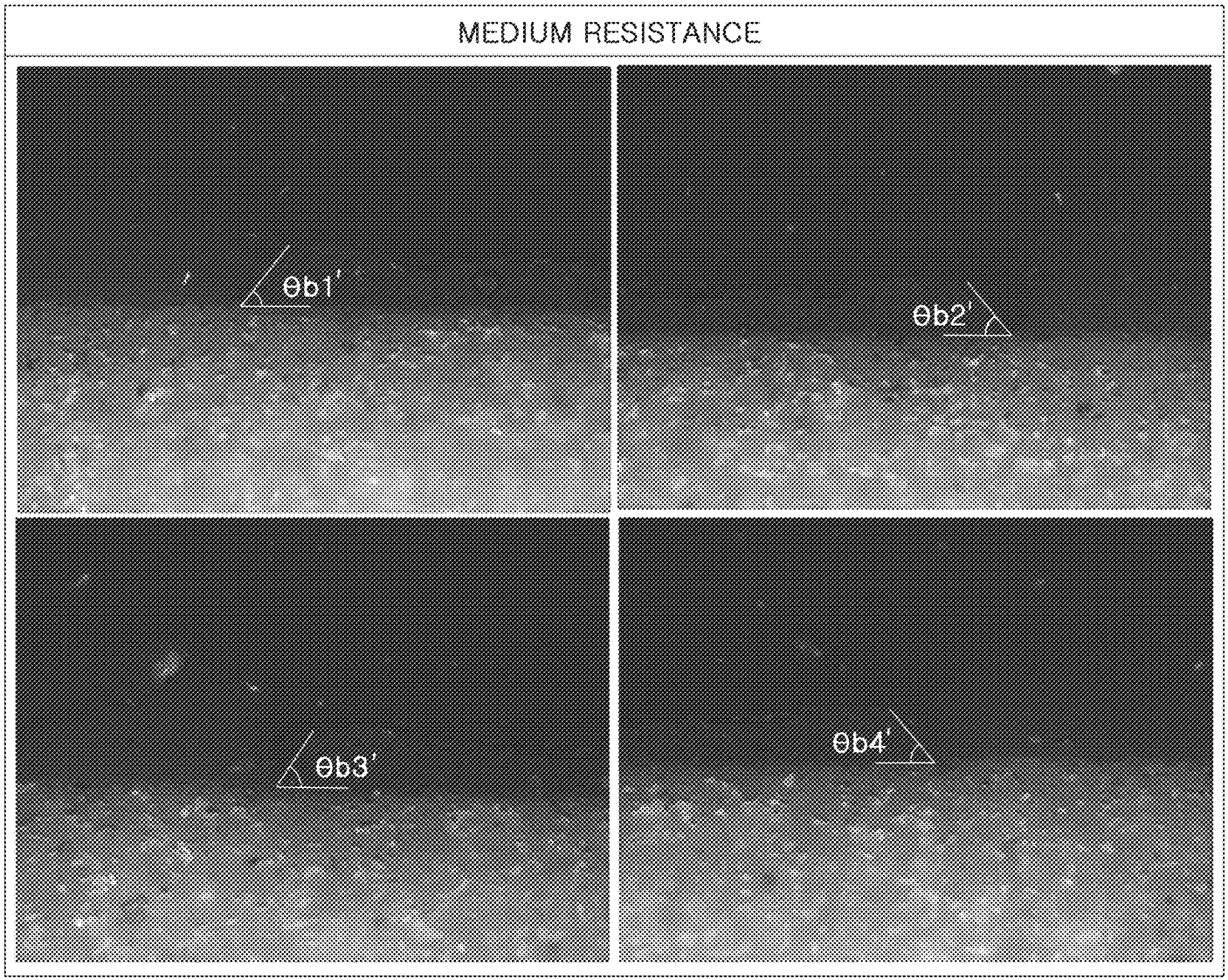
Figure 6C:
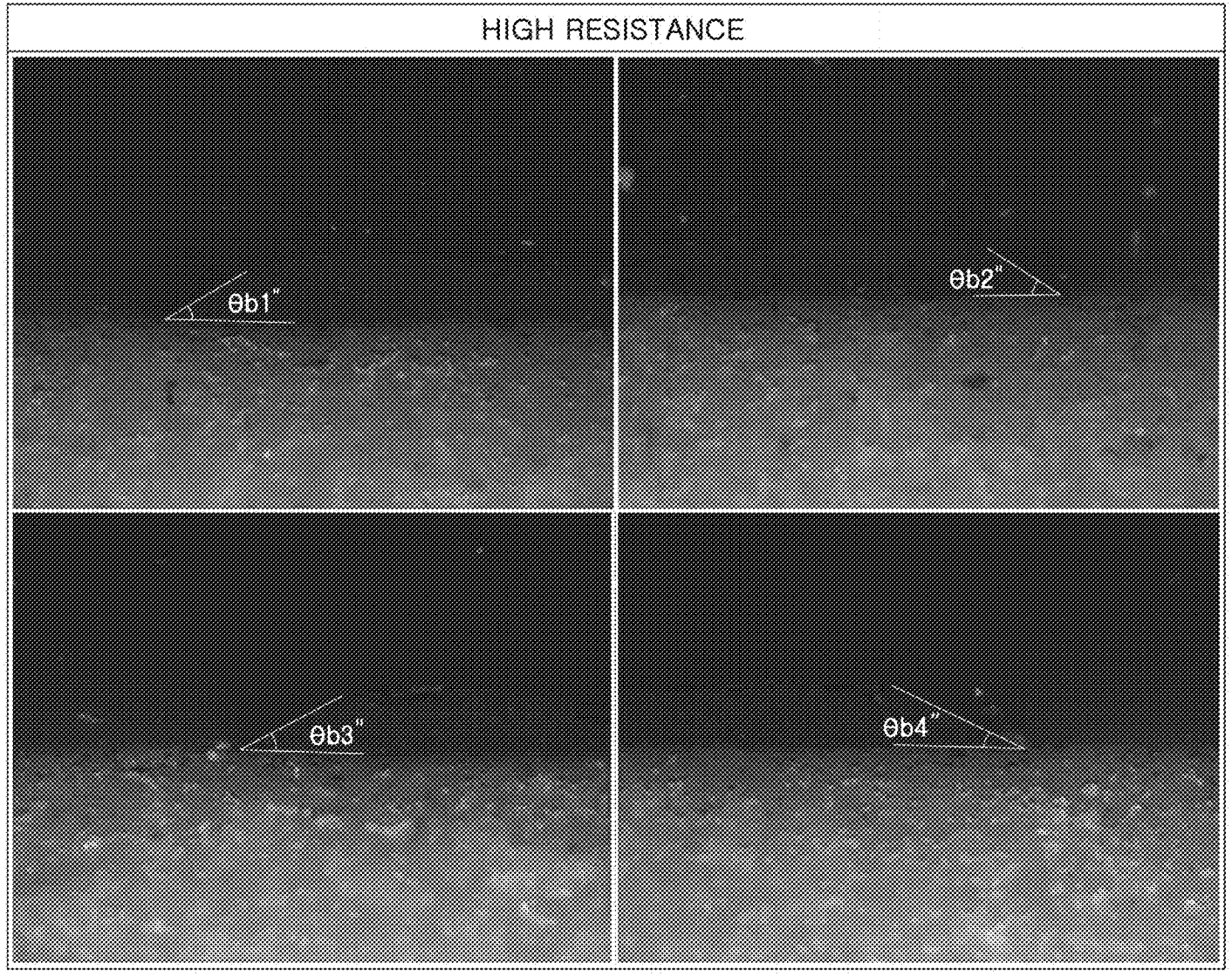
Figure 7:
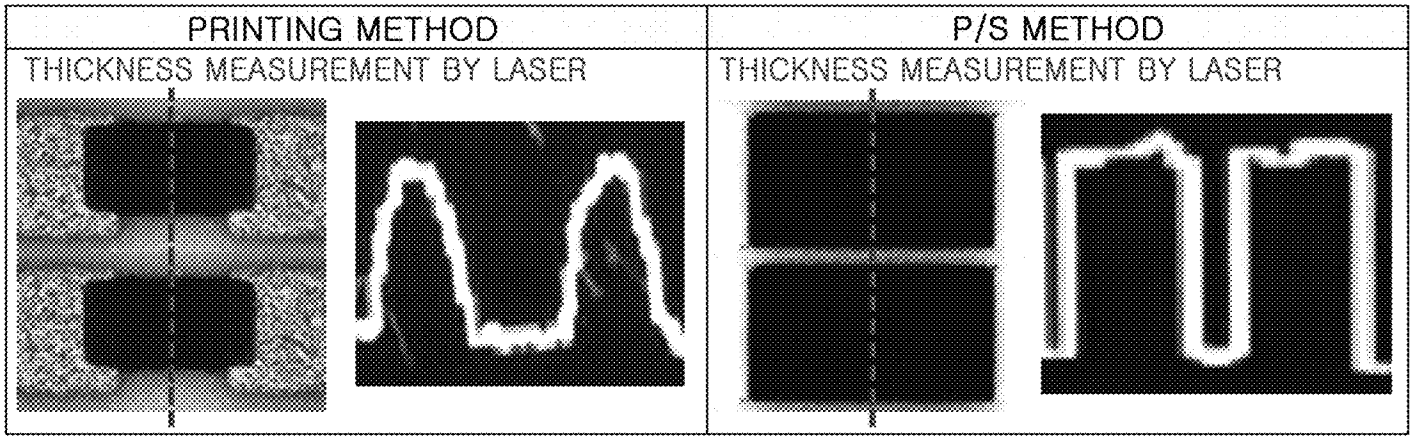
FIG. 7 is a view schematically illustrating a path of current flowing through a resistive layer of FIG. 1.

FIGS. 5A to 5C are views illustrating a resistive layer corresponding to FIG. 2. FIGS. 6A to 6C are views illustrating a resistive layer corresponding to FIG. 3. FIG. 7 is a view schematically illustrating the path of electric current flowing through the resistive layer of FIG. 1.

Referring to FIGS. 1 to 3, a resistor element 1000 according to an exemplary embodiment includes a base substrate 100, a resistive layer 200, first to fourth internal electrodes 311, 312, 321 and 322, and a first protective layer 400, a second protective layer 500, and first and second external electrodes 610 and 620.

The base substrate 100 supports the resistive layer 200 and secures the strength of the resistor element 1000. Referring to FIGS. 2 and 3, the base substrate 100 has a first surface 101 and a second surface 102 opposing each other in a thickness direction Z, a third surface 103 and a fourth surface 104 that connect the first surface 101 and the second surface 102 and opposes each other in a width direction Y, and a fifth surface 105 and a sixth surface 106 connecting the first surface 101 and the second surface 102 and opposing each other in a longitudinal direction X.

A material of the base substrate 100 is not particularly limited, and for example, a substrate including alumina ($Al_2O_3$) or an insulating substrate may be used as the base substrate 100. The base substrate 100 has a predetermined thickness, and may be formed of a thin plate shape in which the shape of any one of the first surface 101 to the sixth surface 106 is rectangular, and the surface is anodized, and may be formed of an insulating alumina ($Al_2O_3$) material of which the surface is anodized.

In addition, the base substrate 100 is formed of a material having excellent thermal conductivity, and thus, may serve as a heat diffusion passage through which heat generated in the resistive layer 200 dissipates externally when the resistor element is used.

The resistive layer 200 is disposed on the second surface 102 of the base substrate 100. In addition, the resistive layer 200 is connected to the first to fourth internal electrodes 311, 312, 321 and 322 and the first and second external electrodes 610 and 620, to be described later, thereby forming a predetermined resistance between the first to second external electrodes 610 and 620.

Referring to FIGS. 2 and 3, the resistive layer 200 has one surface 201 disposed on the second surface 102 of the base substrate 100 and facing the first surface 101 of the base substrate 100, the other surface 202 opposing the one surface 201, and first to fourth sides 203, 204, 205 and 206 connecting the one surface 201 and the other surface 202. The first side 203 and the second side 204 oppose each other in a direction in which the first and second internal electrodes 311 and 312 to be described later are spaced apart, and the third side 205 and the fourth side 206 of the resistive layer 200 connect the first side 203 and the second side 204 and oppose each other. For example, the first side 203 and the second side 204 oppose each other in the longitudinal direction X of the base substrate 100, and the third side 205 and the fourth side 206 oppose each other in the width direction Y of the base substrate 100. A stacking direction of the resistive layer 200 and the base substrate 100 may be in parallel to the thickness direction Z.

In this embodiment, an angle that each of the sides 203, 204, 205 and 206 of the resistive layer 200 forms with the second surface 102 of the base substrate 100 refers to an angle between each of the sides 203, 204, 205 and 206 inside the resistive layer 200 and the base substrate 100. Therefore, inside the resistive layer 200, the angle formed by each side 203, 204, 205, 206 of the resistive layer 200 with the base substrate 100 has a numerical range not exceeding 90 degrees.

Referring to FIGS. 2 and 3, an angle (b) that each of the third side 205 and the fourth side 206 of the resistive layer 200 forms with the second side 102 of the base substrate 100 is greater than an angle (a) formed by each of the first side 203 and the second side 204 of the resistive layer 200 with the second side 102 of the base substrate 100.

FIGS. 5A to 5C and FIGS. 6A to 6C are drawings corresponding to both ends of the first side 203 and the second side 204 of the resistive layer 200 of FIG. 2, and both ends of the third side 205 and the fourth side 206 of the resistive layer 200 of FIG. 3, at low resistance (6Ω), medium resistance (6 kΩ), and high resistance (160 kΩ), respectively. Table 1 is a table illustrating the angles (θa1 to θb4") of the respective experimental examples corresponding to FIGS. 5A to 6C.

TABLE 1

| | Low Resistance (6 Ω) | | Medium Resistance (6 kΩ) | | High Resistance (160 kΩ) | |
|---|---|---|---|---|---|---|
| Angle(°) | Related Art | Pattern Scribing | Related Art | Pattern Scribing | Related Art | Pattern Scribing |
| Avg (Average) | 6.8 | 51.2 | 6.0 | 52.5 | 6.4 | 29.4 |
| Experimental Example 1 | θa1 (6.8) | θb1 (34.2) | θa1' (5.3) | θb1' (52.8) | θa1" (5.8) | θb1" (31.5) |
| Experimental Example 2 | θa2 (6.9) | θb2 (68.1) | θa2' (6.2) | θb2' (49.8) | θa2" (7.7) | θb2" (33.0) |
| Experimental Example 3 | θa3 (7.5) | | θa3' (6.3) | θb3' (58.0) | θa3" (6.9) | θb3" (29.4) |
| Experimental Example 4 | θa4 (5.8) | | θa4' (6.2) | θb4' (49.3) | θa4" (5.2) | θb4" (23.7) |

For example, referring to FIGS. 2 and 5A and Table 1, cross-sectional shapes of the first side 203 and the second side 204 of the resistive layer 200 provide an average of 6.8 degrees as in a related art printing method, which is a result of not laser scribing the first side 203 and the second side 204 of the resistive layer 200. In this case, it can be seen that in the middle and high-resistance regions as well as in the low-resistance region, relatively small angles of respective average 6.0 and 6.4 degrees are represented. Meanwhile, referring to FIGS. 3 and 6A and Table 1, cross-sectional shapes of the third side 205 and the fourth side 206 of the resistive layer 200 provide relatively large angles of 51.2 degrees on average, differently from in the related art printing method. This case is a result of laser scribing the third side 205 and the fourth side 206 of the resistive layer 200, and it can be seen that, not only in a low resistance region but also in medium resistance and high resistance regions, relatively large angles of average 52.5 degrees and 29.4 degrees are represented. For example, when synthesizing the experimental examples, the angle (b) that each of the third side 205 and the fourth side 206 of the resistive layer 200 processed by laser forms with the second side 102 of the base substrate 100 is greater than the angle (a) formed by each of the first side 203 and the second side 204 of the resistive layer 200 and the second side 102 of the base substrate 100, and is approximate to vertical.

In detail, the angle (b) formed between each of the third side 205 and the fourth side 206 of the resistive layer 200 and the second side 102 of the base substrate 100 may be 20 degrees or more and 90 degrees or less. If the angle (b) is less than 20 degrees, the uniformity of the current path through the resistive layer 200 during trimming may be deteriorated. For example, as in the related art printing method, electrical characteristics may be deteriorated. In addition, since the third side 205 and the fourth side 206 of the resistive layer 200 are surfaces processed by a laser; inside the resistive layer 200, the angle between the third side 205 and the fourth side 206 of the resistive layer 200 and the second side 102 of the base substrate 100 does not exceed 90 degrees, as described above.

In addition, a deviation between, a distance (d1) from the fifth surface 105 of the base substrate 100 to the third side 205 of the resistive layer 200 and a distance (d2) from the sixth surface 106 of the base substrate 100 to the fourth side 206 of the resistive layer 200, may be within 20 μm, which is a characteristic structure by laser scribing both sides of the resistive layer 200 opposing in the width direction Y, and this will be described later.

Figure 4A:
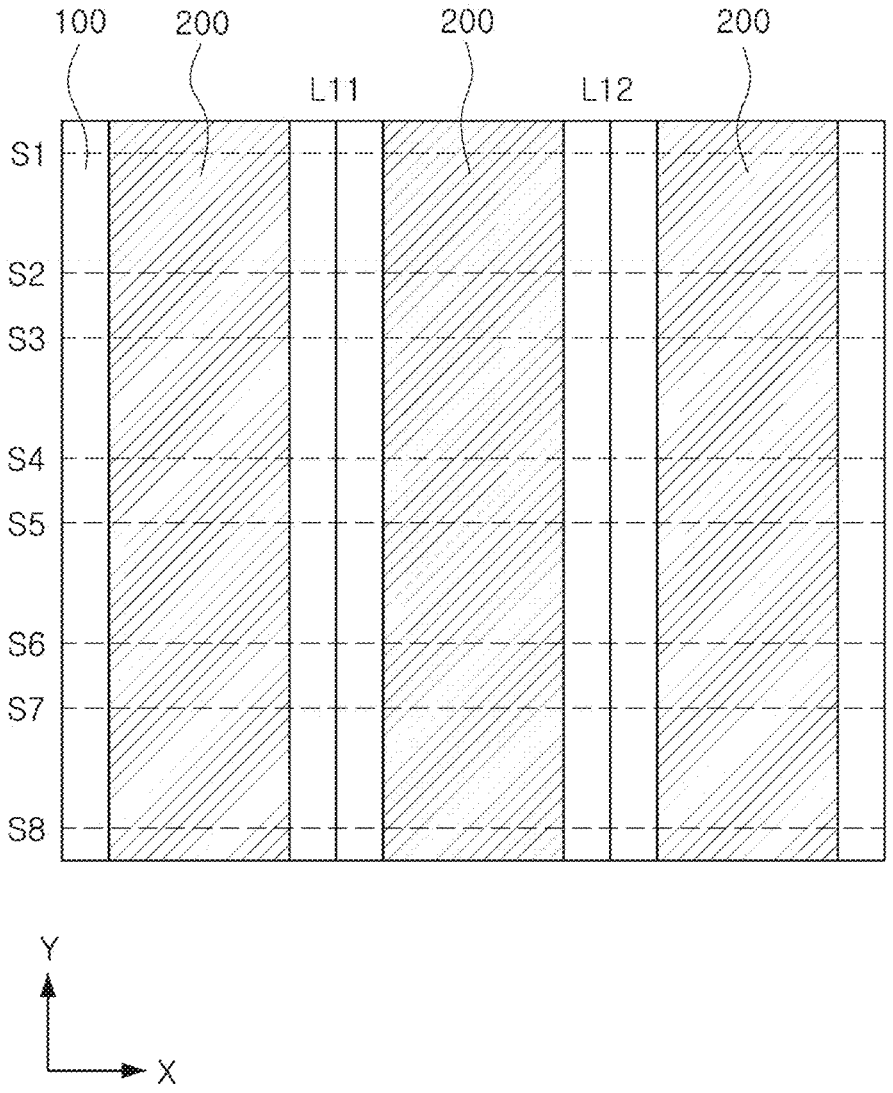
FIGS. 4A to 4E are views schematically illustrating a process of manufacturing the resistor element of FIG. 1.

Referring to FIG. 4A, primary dividing lines L11 and L12 are formed on the base substrate 100 in the width direction Y by using a laser. The primary dividing lines L11 and L12 function as processing lines for processing resistor elements into individual components from the form of an array in the future. After forming the primary dividing lines L11 and L12, the resistive layer 200 is disposed in the width direction Y in a strip shape.

Figure 4B:
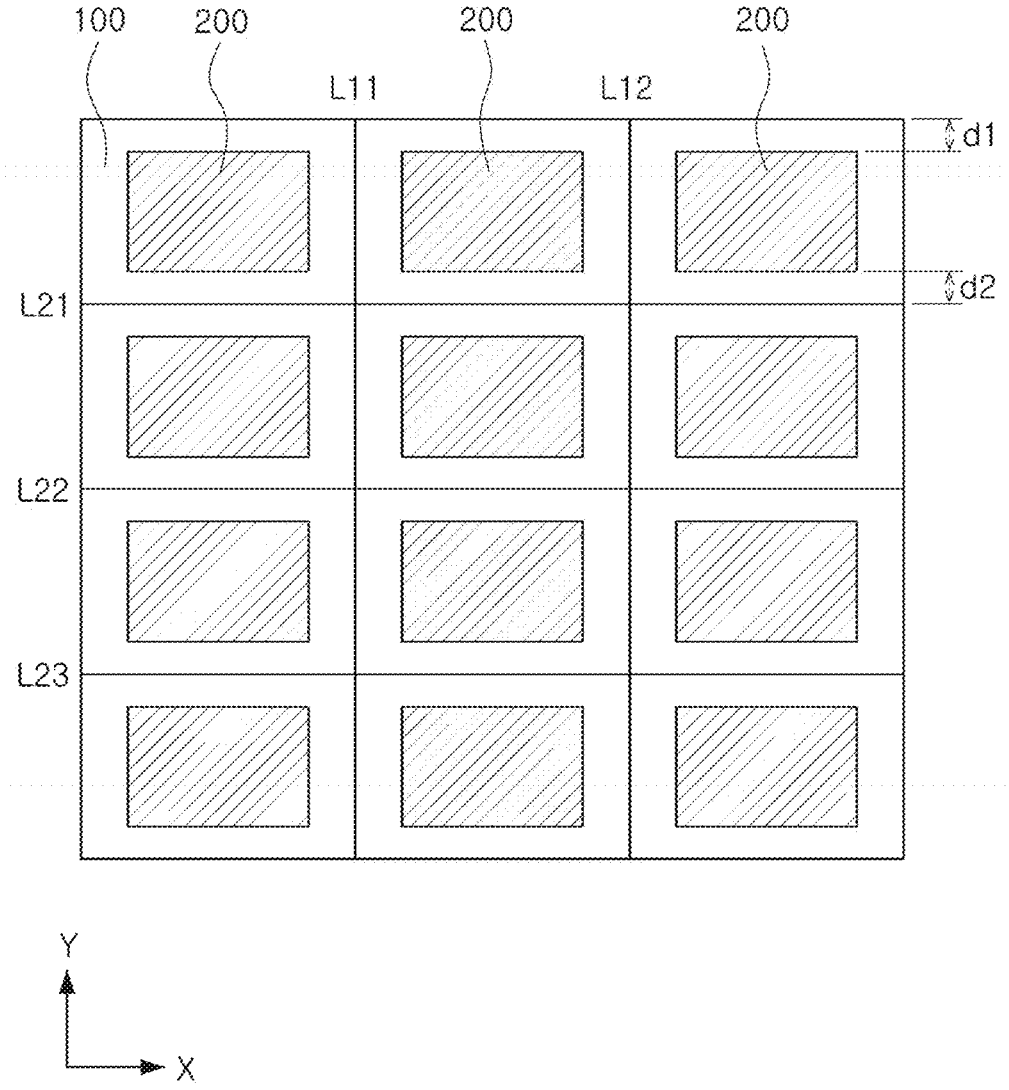

Referring to FIG. 4B, the resistive layer 200 is divided into a plurality of respective patterns along the processing lines S1 to S8 of FIG. 4A. For example, the resistive layer 200 is processed by laser scribing in the longitudinal direction X of the resistive layer 200. As a result, referring to FIGS. 3 and 4B, the third side 205 and the fourth side 206 of the resistive layer 200 are processed surfaces processed by laser scribing. If a resistive layer is formed by a printing method in a related art, a deviation between the distance (d1) and the distance (d2) may not be uniform. For example, there is a problem in that the precision of the printing alignment is poor, the current path through the resistive layer during trimming is non-uniform, and it is difficult to efficiently use the area of the resistive layer. To support this, when the resistance component was overloaded with 2.5 times the rated voltage, the rate of change of the resistance value at the steady state and at the moment of being overloaded was measured. That is, in the case where the angle (b) is less than 20 degrees and in the case of 20 degrees or more and 90 degrees or less, the rate of change of the resistance value was respectively measured. Here, the application of the rated voltage may be made in the form of applying the voltage by repeating On/Off. In addition, the experiment was conducted in the condition that 2.5 times the rated voltage was applied in the On state for 5 seconds. When the angle (b) is 20 degrees or more and 90 degrees or less, the measured rate of change of the resistance value was −0.3% or more and +0.3% or less, but when the angle (b) is less than 20 degrees, the rate of change of the resistance value is −2.5% or more +2.5% or less. That is, when the angle (b) is less than 20 degrees, it can be seen that the rate of change of the resistance value increases and the uniformity of the current density decreases.

In an exemplary embodiment of the present disclosure to prevent the occurrence of this problem, the third side 205 and the fourth side 206 of the resistive layer 200 opposing each other in the width direction Y are processed by laser, to improve the precision of alignment of patterns of the resistive layer 200. To measure the printing precision of the pattern of the resistive layer 200, in the present disclosure, 36 sample resistor elements were used to measure the distance (d1) and the distance d2. The result of calculating the deviation (d1-d2) of the distances is described in the Table 2 in the low resistance (10Ω), medium resistance (6 kΩ) and high resistance (160 kΩ) regions in which the resistor element is actually used to increase the reliability of the experimental results.

TABLE 2

| Classification | | Low Resistance (10Ω) | Medium Resistance (6kΩ) | High Resistance (160kΩ) |
|---|---|---|---|---|
| Resistor | d1 (μm) | 93.3 | 90.3 | 101.7 |
| Element 1 | d2 (μm) | 95.4 | 108.8 | 108.5 |
| Resistor | d1 (μm) | 90.0 | 89.2 | 106.9 |
| Element 2 | d2 (μm) | 95.5 | 109.3 | 104.4 |
| Resistor | d1 (μm) | 91.0 | 89.5 | 105.4 |
| Element 3 | d2 (μm) | 98.1 | 107.8 | 106.0 |
| Resistor | d1 (μm) | 92.5 | | 98.2 |
| Element 4 | d2 (μm) | 94.0 | | 118.2 |
| Resistor | d1 (μm) | 90.2 | 95.3 | 99.0 |
| Element 5 | d2 (μm) | 98.1 | 113.6 | 113.1 |
| Resistor | d1 (μm) | 93.9 | | |
| Element 6 | d2 (μm) | 96.9 | | |
| Resistor | d1 (μm) | 88.8 | 90.3 | 95.4 |
| Element 7 | d2 (μm) | 105.7 | 102.0 | 102.4 |
| Resistor | d1 (μm) | 90.5 | 90.7 | 94.6 |
| Element 8 | d2 (μm) | 103.7 | 104.2 | 104.1 |
| Resistor | d1 (μm) | 90.9 | 93.6 | 95.4 |
| Element 9 | d2 (μm) | 107.1 | 109.4 | 107.9 |
| Resistor | d1 (μm) | 90.3 | | 102.4 |
| Element 10 | d2 (μm) | 97.6 | | 107.3 |
| Resistor | d1 (μm) | 94.7 | | 101.6 |
| Element 11 | d2 (μm) | 92.5 | | 108.7 |
| Resistor | d1 (μm) | 91.0 | 89.5 | 105.0 |
| Element 12 | d2 (μm) | 101.3 | 109.5 | 106.0 |
| Resistor | d1 (μm) | 92.4 | 94.7 | 98.3 |
| Element 13 | d2 (μm) | 96.1 | 112.3 | 117.9 |
| Resistor | d1 (μm) | 93.2 | 96.3 | 97.8 |
| Element 14 | d2 (μm) | 93.9 | 114.3 | 111.1 |
| Resistor | d1 (μm) | 90.3 | 96.1 | 98.6 |
| Element 15 | d2 (μm) | 98.7 | 114.5 | 114.5 |
| Resistor | d1 (μm) | | 90.5 | 96.2 |
| Element 16 | d2 (μm) | | 106.5 | 105.0 |
| Resistor | d1 (μm) | 90.6 | 90.3 | 93.9 |
| Element 17 | d2 (μm) | 105.5 | 107.3 | 107.9 |
| Resistor | d1 (μm) | 90.1 | 96.7 | 98.3 |
| Element 18 | d2 (μm) | 107.7 | 103.5 | 111.6 |
| Resistor | d1 (μm) | 90.3 | | 103.2 |
| Element 19 | d2 (μm) | 95.4 | | 109.6 |
| Resistor | d1 (μm) | 92.2 | | 102.5 |
| Element 20 | d2 (μm) | 97.7 | | 108.2 |
| Resistor | d1 (μm) | 92.5 | | 103.9 |
| Element 21 | d2 (μm) | 98.3 | | 105.2 |
| Resistor | d1 (μm) | 95.5 | 93.2 | 99.1 |
| Element 22 | d2 (μm) | 95.5 | 93.2 | 99.1 |
| Resistor | d1 (μm) | 90.3 | 95.4 | 96.1 |
| Element 23 | d2 (μm) | 92.5 | 113.4 | 113.8 |
| Resistor | d1 (μm) | 93.6 | 96.1 | 96.9 |
| Element 24 | d2 (μm) | 97.0 | 112.3 | 116.7 |
| Resistor | d1 (μm) | 91.7 | 91.1 | 97.0 |
| Element 25 | d2 (μm) | 107.4 | 105.7 | 103.5 |
| Resistor | d1 (μm) | 91.4 | 94.0 | 94.7 |
| Element 26 | d2 (μm) | 104.8 | 105.5 | 105.7 |
| Resistor | d1 (μm) | 89.5 | 94.0 | 97.0 |
| Element 27 | d2 (μm) | 106.6 | 104.2 | 110.1 |
| Resistor | d1 (μm) | 90.8 | 89.5 | 100.2 |
| Element 28 | d2 (μm) | 95.4 | 109.2 | 109.3 |
| Resistor | d1 (μm) | 93.4 | | 102.2 |
| Element 29 | d2 (μm) | 95.8 | | 106.7 |
| Resistor | d1 (μm) | 91.0 | 91.9 | 104.7 |
| Element 30 | d2 (μm) | 100.2 | 109.6 | 106.7 |
| Resistor | d1 (μm) | 92.5 | 95.4 | 97.6 |
| Element 31 | d2 (μm) | 94.7 | 113.8 | 115.2 |
| Resistor | d1 (μm) | 91.0 | | 96.1 |
| Element 32 | d2 (μm) | 96.9 | | 113.0 |
| Resistor | d1 (μm) | 95.5 | 95.4 | 99.1 |
| Element 33 | d2 (μm) | 94.7 | 91.7 | 95.9 |
| Resistor | d1 (μm) | 92.5 | 91.7 | 95.9 |
| Element 34 | d2 (μm) | 109.8 | 102.7 | 102.7 |
| Resistor | d1 (μm) | 86.6 | 93.4 | 93.9 |
| Element 35 | d2 (μm) | 103.5 | 106.4 | 107.1 |

TABLE 2-continued

| Classification | | Low Resistance (10Ω) | Medium Resistance (6kΩ) | High Resistance (160kΩ) |
|---|---|---|---|---|
| Resistor Element 36 | d1 (μm) | 90.3 | 93.7 | 94.8 |
| | d2 (μm) | 105.5 | 103.5 | 108.6 |

For example, referring to Table 2, FIGS. 3 and 4B, a deviation between the distance (d1) and the distance (d2) may be about −20 μm or more and +20 μm or less. For example, since the resistive layer 200 according to an exemplary embodiment is not affected by printing blurring or misalignment, the width of the resistive layer 200 may be designed as wide as possible, while having a uniform current path. As a result, improved electrical characteristics may be implemented as compared with the case of the same size in the related art device. FIG. 7 illustrates waveforms provided by measuring the current paths of the resistor element 1000 according to the related art printing method and according to the laser scribing (pattern scribing) method in an exemplary embodiment of the present disclosure, respectively. For example, based on the width direction Y of the resistor element 1000, the results of measuring the thickness using a laser were compared. In the exemplary embodiment of the present disclosure in which both sides of the resistive layer 200, opposing each other in the width direction Y, are respectively processed by a laser, it can be seen that a path of current flowing through the resistive layer 200 is more uniformly implemented in a rectangular shape. On the other hand, when the difference (d1-d2) of the distance is more than 20 μm, the resistive layer 200 is tilted toward the fifth surface 105 or the sixth surface 106 of the base substrate 100, resulting in misalignment of printing. As a result, when the current is applied, smearing of plating may occur on the side surfaces of the first protective layer 400 or the second protective layer 500, thereby deteriorating the characteristics of the component. Therefore, in this embodiment, a deviation between the distance (d1) and the distance (d2) may be within 20 μm. To support this, the resistance element was overloaded with 2.5 times the rated voltage to measure the rate of change of the resistance value in a steady state and in an overloaded short time. That is, in the case where the distance difference (d1-d2) is more than 20 μm and within 20 μm, the rate of change of the resistance value was measured, respectively. Here, the measurement condition was applied 2.5 times the rated voltage in an On state for 1 second and an Off state for 25 seconds, and 10,000 experiments were performed using this as one cycle. When the distance difference (d1-d2) is within 20 μm, the measured rate of change of the resistance value as −0.5% or more and +0.5% or less, but when the difference in distance (d1-d2) exceeds 20 μm, the measured rate of change of the resistance value was about +6.0%. That is, when the difference (d1-d2) of the distance is more than 20 μm, it can be seen that the rate of change of the resistance value increases, resulting in a non-uniform current flow.

The resistive layer 200 may include Ag, Pd, Cu, Ni, a Cu—Ni-based alloy, a Ni—Cr-based alloy, Ru oxide, Si oxide, Mn, a Mn-based alloy, etc. as a main component, and may include various materials depending on a required resistance value. In detail, the resistive layer 200 may include a relatively more amount of metal formed of silver (Ag) or palladium (Pd) or alloys thereof in the low-resistance region, and the more toward the high resistance region, the more glass or $RuO_2$ may be included.

Figure 4C:
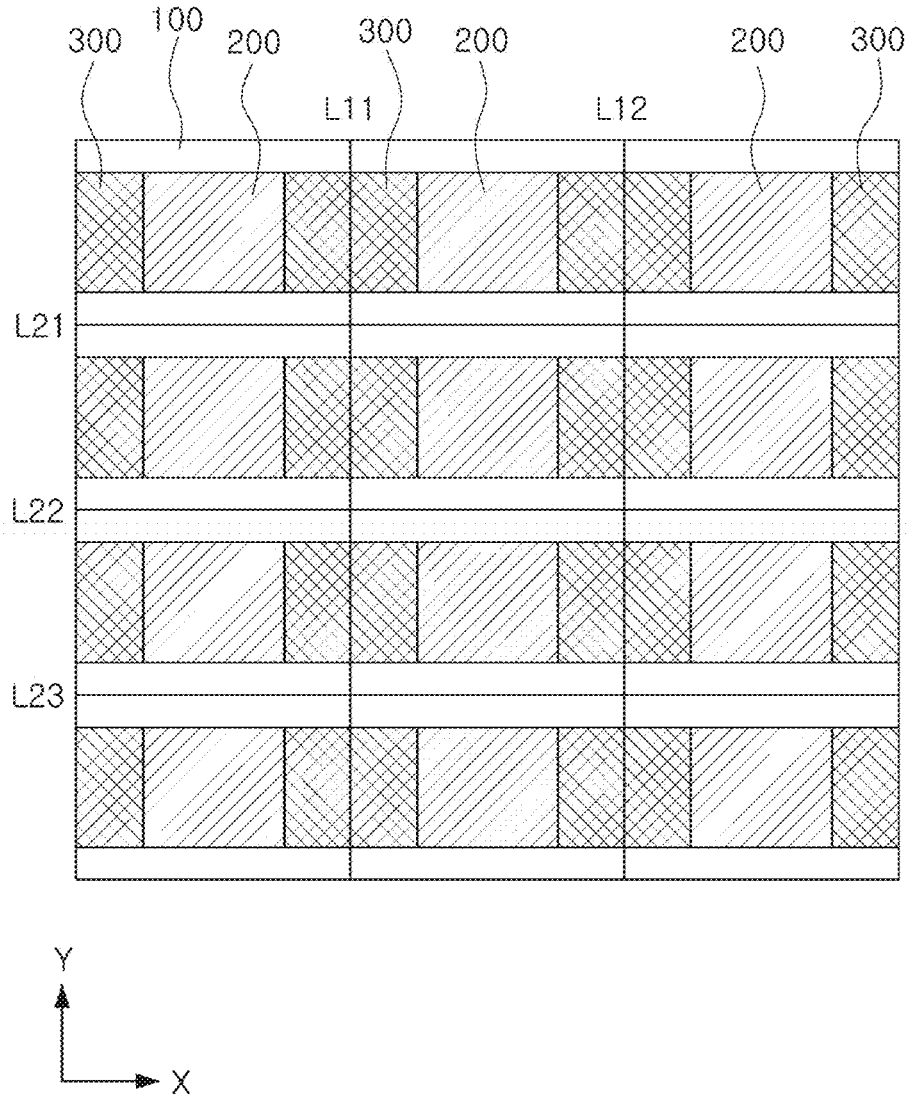

The first and second internal electrodes 311 and 312 are spaced apart from each other on the second surface 102 of the base substrate 100 and are connected to the resistive layer 200. Additionally, to support the base substrate 100, the third and fourth internal electrodes 321 and 322 may be disposed to be spaced apart from each other on the first surface 101 of the base substrate 100. Referring to FIG. 4C, after the resistive layer 200 is sintered, the internal electrodes 300 are formed on both ends of the base substrate 100 in the longitudinal direction X. For example, the internal electrodes 300 are disposed to be spaced apart from each other in the longitudinal direction X of the resistor element 1000 with the resistive layer 200 interposed therebetween. The material of the internal electrodes 300 is not limited, but may include silver (Ag).

Figure 4D:
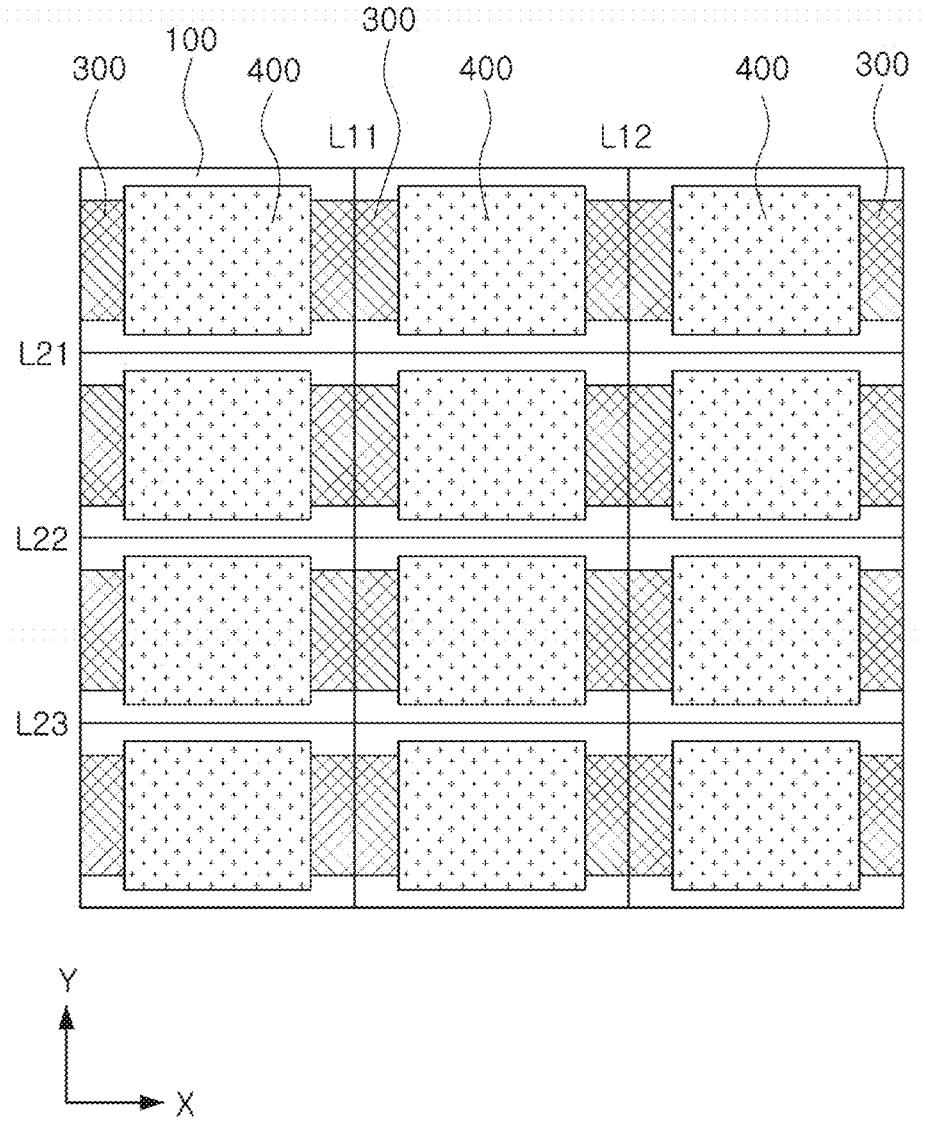

The first protective layer 400 is disposed on the resistive layer 200 to cover the resistive layer 200 and portions of the first and second internal electrodes 311 and 312. Referring to FIG. 4D, although the first protective layer 400 is formed to cover the resistive layer 200 and a portion of the internal electrode 300, the first protective layer 400 does not extend up to both ends of the base substrate 100 in the width direction Y. The material of the first protective layer 400 is not particularly limited, but may include glass to protect the resistive layer 200 in a laser trimming process to be described later.

Although not illustrated in detail, after forming the first protective layer 400, a process of trimming the resistive layer 200 with a laser may be performed. The resistance value of the resistive layer 200 may be determined by trimming. Trimming refers to a process such as cutting for fine adjustment of the resistance value, and may be a process of determining a resistance value set in each resistance portion during circuit design.

Figure 4E:
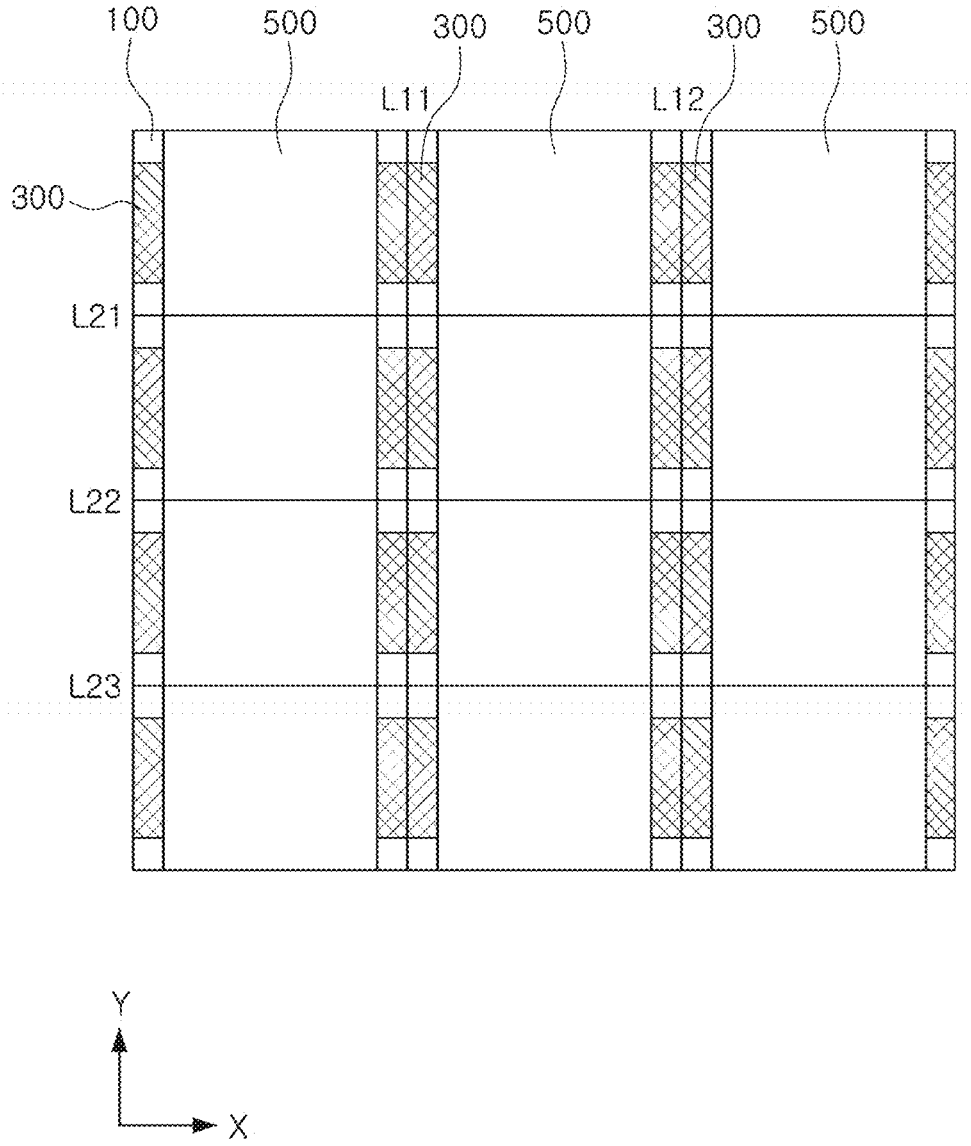

The second protective layer 500 is disposed on the first protective layer 400 to cover the first protective layer 400. Referring to FIG. 4E, the second protective layer 500 extends to both ends of the base substrate 100 in the width direction Y to cover both the resistive layer 200 and the first protective layer 400. In one exemplary embodiment, the second protective layer 500 may partially overlap the first and second internal electrodes 311 and 312 in a stacking direction (e.g., Z direction). In addition, the first and second internal electrodes 311 and 312 may partially overlap the resistive layer 200 in the Z direction. The material of the second protective layer 500 is not particularly limited, but may include a polymer for electrical insulation between the external electrodes 611, 612, 621 and 622 to be described later, and the resistive layer 200. After the second protective layer 500 is formed, division into individual resistor elements 1000 is performed along the secondary dividing lines L21, L22 and L23. Thereafter, first layers 611 and 621 of the external electrodes 611, 612, 621 and 622 are formed by thin film sputtering or the like, and then second layers 612 and 622 are formed by a plating method.

The first and second external electrodes 610 and 620 may be disposed on the third surface 103 and the fourth surface 104 of the base substrate 100, respectively, and further extend to cover the first and second surfaces 101 and 102 and the fifth and sixth surfaces 105 and 106 of the base substrate 100. Referring to FIGS. 1 and 2, the first and second external electrodes 610 and 620 are disposed to be spaced apart from each other in the longitudinal direction X of the base substrate 100 with the resistive layer 200 interposed therebetween. The first and second external electrodes 610 and 620 further include the first layers 611 and 621 formed by thin film sputtering and the second layers 612 and 622 disposed on the first layers 611 and 621.

Although not limited, the first layers 611 and 621 may be formed by a method of applying a conductive paste on the resistive layer 200 and the base substrate 100, and the coating method may be a screen printing method or the like. On the first layers 611 and 621, the second layers 612 and 622 formed by plating may be disposed to cover the first layers 611 and 621.

As set forth above, a resistor element according to an exemplary embodiment may more precisely control the path of current within the same area.

While this disclosure includes specific examples, it will be apparent to one of ordinary skill in the art that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed to have a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A resistor element comprising:

a base substrate having a first surface and a second surface opposing the first surface, a third surface and a fourth surface connecting the first surface and the second surface and opposing each other, and a fifth surface and a sixth surface connecting the first surface and the second surface and opposing each other;

a resistive layer having a first surface disposed on the second surface of the base substrate and facing the first surface of the base substrate, a second surface opposing the first surface of the resistive layer, and first to fourth sides connecting the first surface of the resistive layer to the second surface of the resistive layer; and first and second internal electrodes spaced apart from each other on the second surface of the base substrate and connected to the resistive layer, wherein the first and second sides of the resistive layer face each other in a direction in which the first and second internal electrodes are spaced apart, and the third and fourth sides of the resistive layer connect the first and second sides to each other and face each other, and an internal angle of the resistive layer between each of the third and fourth sides of the resistive layer and the second surface of the base substrate is greater than an internal angle of the resistive layer between each of the first and second sides of the resistive layer and the second surface of the base substrate.

2. The resistor element of claim 1, wherein the internal angle of the resistive layer between each of the third and fourth sides of the resistive layer and the second surface of the base substrate is 20 degrees or more and 90 degrees or less.

3. The resistor element of claim 1, wherein the third and fourth sides of the resistive layer include laser-cut surfaces.

4. The resistor element of claim 1, wherein the resistive layer includes AgPd.

5. The resistor element of claim 1, wherein the resistive layer includes glass.

6. The resistor element of claim 1, wherein the resistive layer includes $RuO_2$.

7. The resistor element of claim 1, wherein the base substrate includes $Al_2O_3$.

8. The resistor element of claim 1, further comprising a first protective layer disposed on the resistive layer to cover the resistive layer and portions of the first and second internal electrodes.

9. The resistor element of claim 8, further comprising a second protective layer disposed on the first protective layer to cover the first protective layer.

10. The resistor element of claim 9, wherein the second protective layer partially overlaps the first and second internal electrodes in a stacking direction of the resistive layer and the base substrate.

11. The resistor element of claim 1, wherein the first and second internal electrodes partially overlap the resistive layer in a stacking direction of the resistive layer and the base substrate.

12. The resistor element of claim 1, further comprising third and fourth internal electrodes spaced apart from each other on the first surface of the base substrate.

13. The resistor element of claim 1, further comprising first and second external electrodes covering the third and fourth surfaces of the base substrate, respectively.

14. The resistor element of claim 13, wherein each of the first and second external electrodes further extends to cover at least one of the first, second, fifth, or sixth surface of the base substrate.

15. The resistor element of claim 1, wherein a deviation, between a distance from the fifth surface of the base substrate to the third side of the resistive layer and a distance from the sixth surface of the base substrate to the fourth side of the resistive layer, is within 20 μm.

16. A resistor element comprising:

a base substrate having a first surface and a second surface opposing each other in a thickness direction, a third surface and a fourth surface connecting the first surface to the second surface and opposing each other in a longitudinal direction, and a fifth surface and a sixth surface connecting the first surface to the second surface and opposing each other in a width direction;

a resistive layer having a first surface disposed on the second surface of the base substrate and facing the first surface of the base substrate, a second surface opposing the first surface of the resistive layer, and first to fourth sides connecting the first surface of the resistive layer to the second surface of the resistive layer, the first and second sides opposing each other in the longitudinal direction, the third and fourth sides opposing each other in the width direction; and first and second internal electrodes spaced apart from each other on the second surface of the base substrate and connected to the resistive layer, wherein an internal angle of the resistive layer between each of the third and fourth sides of the resistive layer and the second surface of the base substrate is 20 degrees or more and 90 degrees or less.

17. The resistor element of claim 16, wherein the third and fourth sides of the resistive layer include laser-cut surfaces.

18. The resistor element of claim 16, further comprising a first protective layer disposed on the resistive layer to cover the resistive layer and portions of the first and second internal electrodes.

19. The resistor element of claim 18, further comprising a second protective layer disposed on the first protective layer to cover the first protective layer.

20. The resistor element of claim 16, wherein a deviation, between a distance from the fifth surface of the base substrate to the third side of the resistive layer and a distance from the sixth surface of the base substrate to the fourth side of the resistive layer, is within 20 μm.

* * * * *